US009297154B2

(12) United States Patent
deLoache, III et al.

(10) Patent No.: US 9,297,154 B2
(45) Date of Patent: Mar. 29, 2016

(54) ADAPTABLE SHROUD FOR TOILET PLUMBING RISER

(75) Inventors: Robert Lee deLoache, III, Watkinsville, GA (US); David Cory deLoache, Watkinsville, GA (US)

(73) Assignee: BEHAVIORAL SAFETY PRODUCTS, LLC, Watkinsville, GA (US)

( * ) Notice: Subject to any disclaimer, the term of this patent is extended or adjusted under 35 U.S.C. 154(b) by 1577 days.

(21) Appl. No.: 12/689,130

(22) Filed: Jan. 18, 2010

(65) Prior Publication Data

US 2011/0174392 A1 Jul. 21, 2011

(51) Int. Cl.

*E03D 1/012* (2006.01)
*E03D 1/01* (2006.01)
*E03D 5/00* (2006.01)

(52) U.S. Cl.

CPC *E03D 1/01* (2013.01); *E03D 1/012* (2013.01); *E03D 5/00* (2013.01); *Y10T 29/49947* (2015.01); *Y10T 137/7043* (2015.04)

(58) Field of Classification Search

CPC ..... E03D 1/01; E03D 1/012; E03D 1/0125; E03D 5/00
USPC ..... 137/343, 356, 357, 360, 377, 382; 4/DIG. 15, 252.1, 252.2, 252.3, 252.4; 220/3.3, 3.9, 3.92, 3.94, 8, 476, 477, 220/480, 481; 312/242, 245, 246
See application file for complete search history.

(56) References Cited

U.S. PATENT DOCUMENTS

| | | | | | |
|---|---|---|---|---|---|
| 1,815,855 | A * | 7/1931 | Lauritano | 52/27 |
| 3,495,276 | A * | 2/1970 | Suess | 52/270 |
| 3,573,344 | A * | 4/1971 | Snyder | 174/57 |
| 3,729,113 | A * | 4/1973 | Lopatka | 220/480 |
| 3,901,406 | A * | 8/1975 | Kivett | 220/8 |
| 4,558,472 | A * | 12/1985 | Fromme et al. | 4/252.3 |
| 5,251,340 | A * | 10/1993 | Su-Land | 4/304 |
| 5,680,949 | A * | 10/1997 | Roesler | 220/8 |
| 6,129,109 | A * | 10/2000 | Humber | 137/360 |
| 2006/0085901 | A1 * | 4/2006 | Janssen | 4/354 |

* cited by examiner

*Primary Examiner* — Kevin Murphy
(74) *Attorney, Agent, or Firm* — Mitch Harris, Atty at Law, LLC; Andrew M. Harris

(57) ABSTRACT

An adaptable toilet plumbing riser shroud provides for fast and simple field installation of toilet plumbing riser shrouds without requiring custom prefabrication of shrouds or constraining the plumbing design to a predetermined shape. Two cover portions, one of which is slidably inserted inside the other are secured together. The cover portions are also secured to a wall behind a toilet plumbing riser using brackets. A bottom cover may be provided and cut to permit the riser to pass therethrough. The bottom cover may also be formed from two portions one slidably inserted in the other and then glued together after cutting with plastic cement. The bottom is then attached to the bottom of the shroud using screws. The cover portions may be molded as a single piece and then singulated, and the bottom cover portions may also be formed as a single piece prior to singulation, as well.

7 Claims, 3 Drawing Sheets

ADAPTABLE SHROUD FOR TOILET PLUMBING RISER

BACKGROUND OF THE INVENTION

1. Field of the Invention

The present invention relates generally to an enclosure for a toilet plumbing riser, and more particularly, to an adaptable enclosure for a toilet plumbing riser that can be field-adjusted to different plumbing configurations.

2. Description of the Related Art

Anti-ligature design is a requirement in many institutional locations. In particular, in rooms where persons may be left unattended and where there is a risk that toilet plumbing might be used as a support to tie a ligature, such as a belt, rope or a cloth, a way to ensure that the plumbing cannot be used in such a manner is desirable.

Further, in other installations, it is desirable to prevent possible damage to or removal of the plumbing fixtures themselves or it may be desirable to shroud the plumbing fixtures so that cleaning is simplified.

Existing plumbing riser shrouds are typically fabricated from stainless steel, for durability and anti-corrosion purposes. Each shroud is typically fabricated as a custom assembly for each installation, and each location in which the shrouds are installed may require multiple designs, since the location of wall studs and other structural features typically causes variation in the exact plumbing details for each fixture. The stainless steel shrouds are heavy and require large shipping volume, are expensive and have a lead time associated with the customization and level of demand at a given time. Also, should a stainless steel cover become dislodged from an installation, it may also serve as a weapon.

Therefore, it would be desirable to provide an adaptable shroud that can be installed over a variation of toilets and toilet plumbing riser configurations by fitting each shroud at the time of installation. It would further be desirable to provide such a shroud that is lightweight, can be multi-packed for shipment and is less usable as a weapon in case it is removed from a wall installation.

SUMMARY OF THE INVENTION

The above objectives, among others, are achieved in an adaptable toilet plumbing riser shroud, a method of manufacture of the shroud and a method for installing the toilet plumbing riser shroud.

The shroud is formed by two cover portions that may be formed from a high impact thermoplastic material, each having a sloped top and in which one of the cover portions is slidably insertable within the other portion to adjust a width of the shroud around the plumbing riser. The back edges and bottom edges of the cover portions can be cut to adjust the height and depth of the shroud. Brackets are used to attached the shroud to a wall adjacent to the plumbing riser, which is generally the wall behind the toilet. The brackets can be formed from metal, or from the same plastic material as the cover portions. A bottom cover can be included to prevent access to the plumbing riser from underneath the shroud, and may be formed from two bottom cover portions, in which one is slidably inserted in the other. The bottom cover portions are cut to permit the riser to pass through the bottom cover. Both the primary cover portions and the bottom cover portions may be molded as a single piece and then singulated into the respective portions.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present invention encompasses toilet plumbing riser shrouds (covers) and their methods of installation and manufacture. Shrouds are a necessity over plumbing risers in facilities such as prisons and mental healthcare institutions in which the riser may serve as an attachment point for a ligature that a person may use in a suicide attempt. Further, shrouds may be desirable in prisons and public facilities to prevent damage to the plumbing itself. The shroud of the present invention is an adaptable shroud that can be field-adjusted and field-modified to cover a particular plumbing riser shape and size, without requiring custom manufacture or long term shutdown of a facility in order to fabricate and install shrouds for different plumbing risers and/or toilet arrangements.

Figure 1:
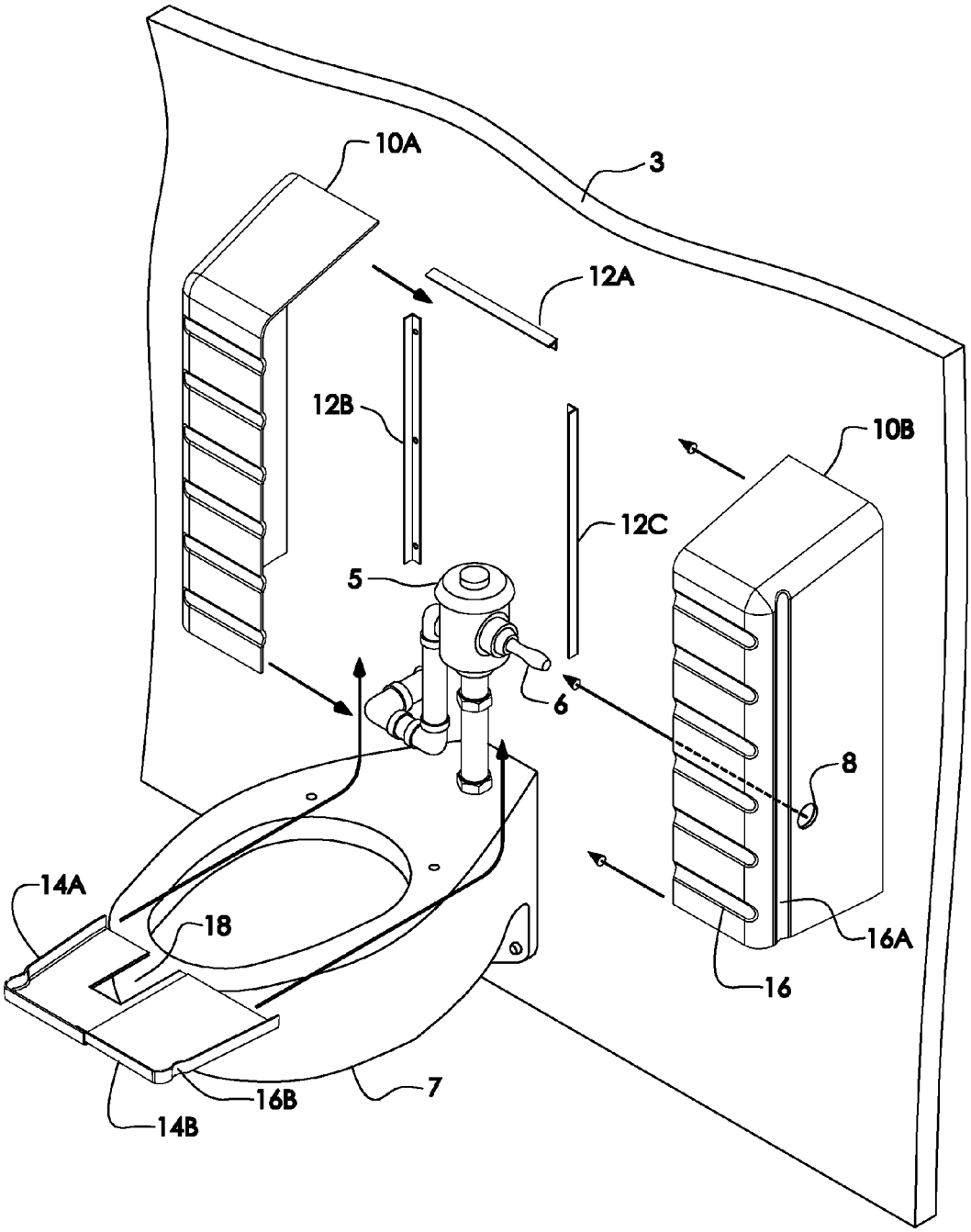
FIG. 1 is an exploded view of a toilet plumbing riser shroud installation in accordance with an embodiment of the invention.

Referring now to FIG. 1, an exploded view of an installation of a toilet plumbing riser shroud is shown, in accordance with an embodiment of the present invention. A commercial toilet bowl 7 is attached to a wall 3 and is plumbed with a plumbing riser 5 that includes a standard flush valve handle 6. Brackets, including a top bracket 12A and two side brackets 12B-12C are affixed to wall 3. Cover portions 10A and 10B are slid together, with cover portion 10B slid inside cover portion 10A to form an overlapped area, which is then secured using screws, or optionally using a cement to form a chemical weld in the overlapped area. Cover portions 10A and 10B each have a sloped top, preventing the use of the top of the shroud as a ligature attachment point. The sloped top may be a single incline toward the front as depicted, or may be a curved slope in one or two dimensions, forming a dome or half-dome shaped top. A hole 8 is formed in cover 10A using a hole saw or a punch, so that flush valve handle 6 protrudes sufficiently to flush the toilet, but with minimum protrusion to reduce the potential of flush valve handle 6 to serve as a ligature attachment point, or that the flush valve handle can be detached for use as a weapon. The corners of cover portions 10A and 10B are rounded to further prevent a person from harming themselves on the corners of the shroud.

Cover portions 10A and 10B are molded from a thermoplastic polymer, providing high impact resistance and may be molded in one piece and singulated by sawing, hot knife separation or other suitable cutting technique. Horizontal bibs 16 provide improvement in rigidity, as well as helping to vertically align cover portions 10A and 10B when they are slid together. The convex inside surfaces of ribs 16 are shaped such that the concave outer surface on one cover portion e.g., cover portion 10B slidably mate with the convex inside surface of the other, e.g., cover portion 10A. A vertical rib 16A is also formed on each of cover portions 10A and 10B to further improve rigiditys of the shroud. During installation, the height of the shroud can be adjusted by cutting an equal amount from the bottom edge of each of cover portions 10A and 10B, and the depth may be adjusted by cutting a portion of the back edges of each of cover portions 10A and 10B that abut wall 3. If the height of the shroud is reduced, it may be necessary to cut side brackets 12B and 12C to match.

Additionally, a bottom cover may be provided as illustrated and formed by two bottom cover portions 14A and 14B, which also may be molded as a single piece and singulated. The bottom cover prevents trash or contraband from being stuffed inside of the shroud, prevents a ligature attachment point from being obtained inside of the shroud, and removes a possible gripping location that might otherwise be used to tear the shroud from wall 3. Bottom cover portion 14B is slid inside bottom cover portion 14A to adjust the width of the bottom cover to match the final width of the inside of the shroud formed by cover portions 10A and 10B. A concave rib section 16B aligns with the inside surface of vertical rib 16A on each side of the bottom cover. Bottom cover portions 14A and 14B are secured together, e.g., by a plastic cement to form a chemical weld. Then, a slot 18 is cut so that plumbing riser 5 can pass through the bottom cover of the shroud, but may be removed as needed by removing the screws securing cover portions 10A and 10B to brackets 12A-12C. Alternatively, if the shroud does not have to be removed, slot 18 may be cut parallel to the back edges of bottom cover portions 14A and 14B at the location where plumbing riser 5 passes through bottom cover, in order to provide a more complete enclosure of plumbing riser 5.

Figure 2:
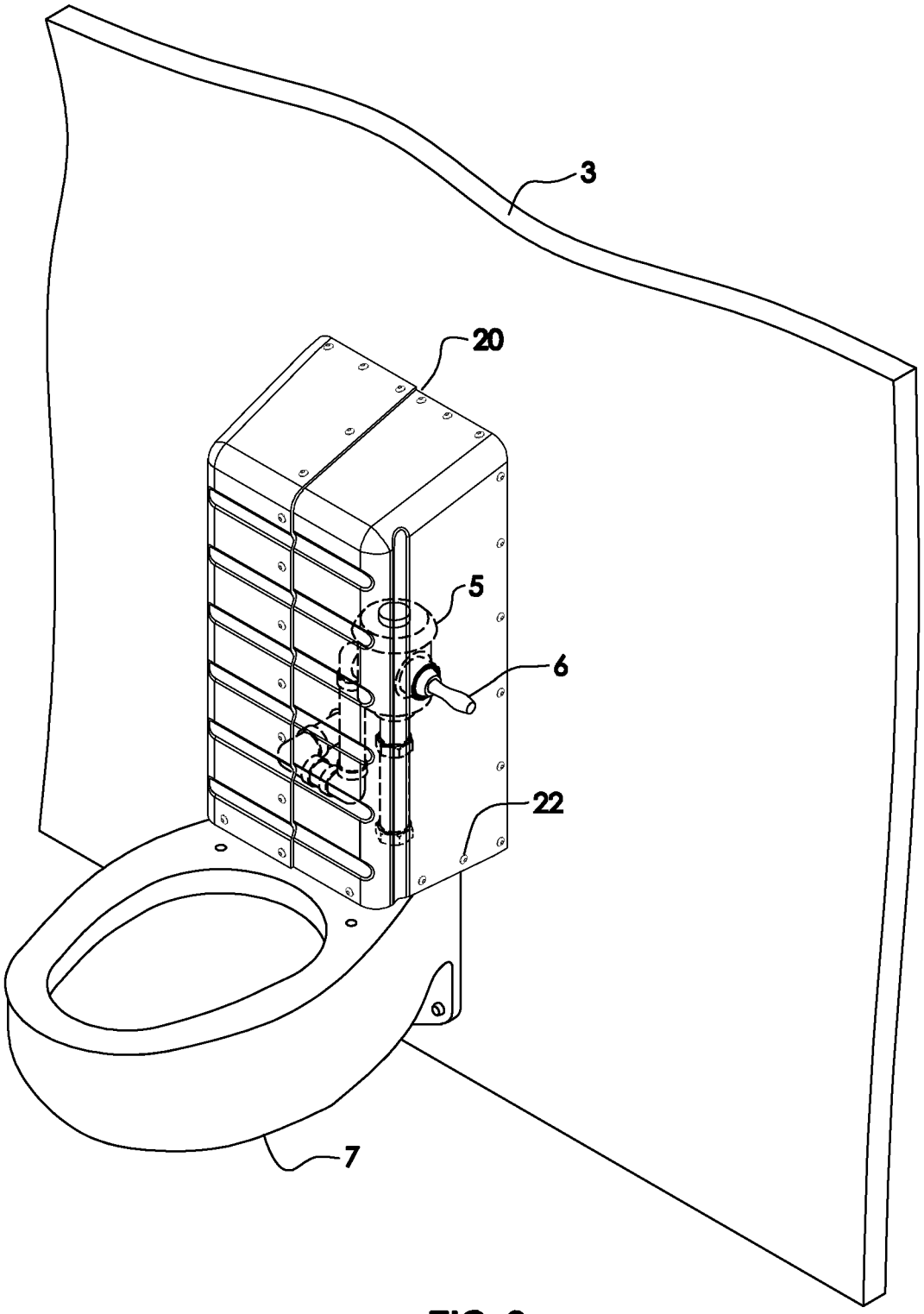
FIG. 2 is a perspective view of a completed shroud installation in accordance with an embodiment of the invention.

Referring now to FIG. 2, a completed shroud assembly 20 is shown. Screws 22 will generally be one-way screws or screws requiring a special tool for removal, so that shroud 20 cannot be disassembled by other means. As mentioned above, cover portions 10A and 10B can be alternatively chemically welded, which may be done in combination with the use of screws 22, as well. If chemical weld is not used, it is generally desirable to use a silicone sealant on the seam between cover portions 10A and 10B, to prevent entry of urine or other liquids inside of shroud 20. It may also be desirable to fill hole 8 with silicone sealant around flush valve handle 6. However, alternatives exist to traditional flush value handle 6 that are generally preferred and will be described below with reference to FIG. 3.

Figure 3:
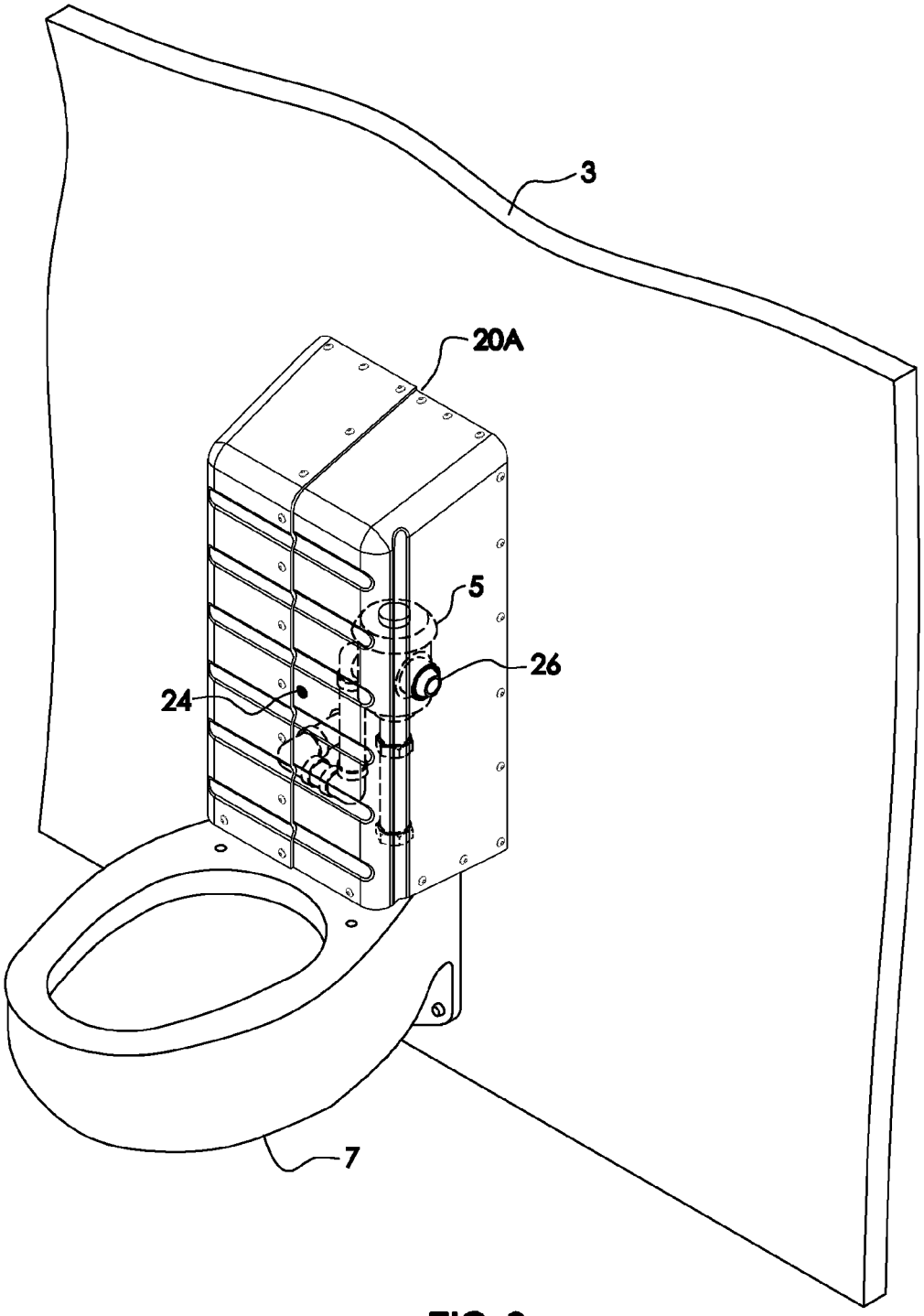
FIG. 3 is an illustration of a toilet plumbing riser shroud installation in accordance with another embodiment of the invention.

Referring now to FIG. 3, an assembled shroud 20A is illustrated to show two alternative flushing mechanisms having a reduced risk of ligature attachment, as well as simplified installation and superior prevention of fluid entry. In a first alternative, the internal flush valve is an infrared activated flush valve. In such installations, a hole 24 is provided in shroud 20A, which can be filled with silicone or a transparent button inserted/glued in. As long as the infrared beam can leave and return through hole 24, the flushing action will operate normally. In a second alternative, a push-button valve actuator 26 replaces the traditional flush handle. Such actuators are available as retro-fits to typical commercial flush valves. In such an installation, a hole is drilled in shroud 20A, as illustrated on the side of shroud 20A, but depending on the plumbing configuration, push-button valve actuator 26 may be located in the front or on the top of shroud 20A. The gap between push-button valve actuator 26 and the edge of the hole in shroud 20A is filled with silicone sealant. Alternatively, a rubber grommet of appropriate size may be used to provide a seal.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A shroud for covering a plumbing riser, the shroud comprising:

a first cover portion having a first sloped top surface, a first side surface and a first front surface, the first cover portion adapted for affixing to an exterior surface of a finished wall so that the first sloped top surface covers a top of the plumbing riser to prevent damage to the plumbing riser or use of the plumbing riser as a ligature securing device;

a second cover portion having a second sloped top surface, the second cover portion adapted for affixing to the exterior surface of the finished wall, wherein the second cover portion is slidably insertable in the first cover portion to provide adjustment of a width of the shroud, and wherein the first sloped top surface and the second sloped top surface form a substantially planar top of the shroud when the second cover portion is inserted in the first cover portion to form a partial overlap of the first cover portion and the second cover portion; and brackets for securing the first cover portion and the second cover portion to the exterior surface of the finished wall so that the first cover portion and the second cover portion surround the plumbing riser on a least the top and sides of the plumbing riser.

2. The shroud of claim 1, further comprising:

a first bottom cover portion; and a second bottom cover portion slidably insertable in the first bottom cover portion so that the first bottom cover portion and the second bottom cover portion form a substantially planar bottom cover having a width adaptable to the width of the shroud, so that the bottom cover can be affixed at the bottom of the shroud to prevent access to the plumbing riser from beneath the shroud.

3. The shroud of claim 1, wherein the first cover portion and the second cover portion are formed from an impact resistant plastic material.

4. The shroud of claim 3, wherein the brackets are formed from a same impact resistant plastic material as the first and second cover portions.

5. The shroud of claim 1, wherein the first cover portion and the second cover portion have ribs that are concave on interior surfaces of the first cover portion and second cover portion and convex on exterior surfaces of the first cover portion and second cover portion, and wherein the concave interior surfaces of ribs on the first cover portion are insertable over the convex exterior surface of ribs on the second cover portion to align the first cover portion and the second cover portion along their lengths when the second cover portion is inserted in the first cover portion.

6. The shroud of claim 1, wherein the brackets comprise:

a first bracket for securing a first side of the first cover portion to the wall;

a second bracket for securing a second side of the second cover portion to the wall; and a third bracket for securing ends of the first and second sloped top surfaces to the wall.

7. A shroud for covering a plumbing riser, the shroud comprising:

a first cover portion having a first top surface, the first cover portion adapted for affixing to an exterior surface of a finished wall so that the first top surface covers a top of the plumbing riser to prevent damage to the pluming riser or use of the plumbing riser as a ligature securing device;

a second cover portion having a second top surface, the second cover portion adapted for affixing to the exterior surface of the finished wall wherein the second cover portion is slidably insertable in the first cover portion to provide adjustment of a width of the shroud, and wherein the first top surface and the second top surface form a substantially planar top of the shroud when the second cover portion is inserted in the first cover portion to form a partial overlap of the first cover portion and the second cover portion; and brackets for securing the first cover portion and the second cover portion to the finished wall adjacent to the plumbing riser.

* * * * *